US008474156B2

(12) United States Patent
Kim

(10) Patent No.: US 8,474,156 B2
(45) Date of Patent: Jul. 2, 2013

(54) VIBRATION GENERATING SHOE AND VIBRATION DEVICE THEREOF

(76) Inventor: Sang Gu Kim, Busan (KR)

( * ) Notice: Subject to any disclaimer, the term of this patent is extended or adjusted under 35 U.S.C. 154(b) by 0 days.

(21) Appl. No.: 13/417,439

(22) Filed: Mar. 12, 2012

(65) Prior Publication Data

US 2012/0169442 A1 Jul. 5, 2012

Related U.S. Application Data

(63) Continuation of application No. PCT/KR2009/007249, filed on Dec. 5, 2009.

(30) Foreign Application Priority Data

Sep. 21, 2009 (KR) ..... 10-2009-0089184

(51) Int. Cl.

| | |
|---|---|
| ***A43B 5/00*** | (2006.01) |
| ***A43B 13/00*** | (2006.01) |
| ***A43B 13/14*** | (2006.01) |
| ***H01H 9/00*** | (2006.01) |

(52) U.S. Cl.
USPC ..... 36/105; 335/207; 36/25 R

(58) Field of Classification Search
USPC ..... 335/87, 252, 235, 207; 36/25 R
See application file for complete search history.

(56) References Cited

U.S. PATENT DOCUMENTS

| | | | | |
|---|---|---|---|---|
| 5,434,549 | A * | 7/1995 | Hirabayashi et al. | 335/229 |
| 5,502,901 | A * | 4/1996 | Brown | 36/28 |
| 5,809,157 | A * | 9/1998 | Grumazescu | 381/412 |
| 5,896,076 | A * | 4/1999 | van Namen | 335/229 |
| 6,501,357 | B2 * | 12/2002 | Petro | 335/229 |
| 6,798,090 | B2 * | 9/2004 | Cheung et al. | 310/17 |
| 2001/0005946 | A1 * | 7/2001 | Brown | 36/28 |
| 2010/0139124 | A1 * | 6/2010 | Kim | 36/103 |

FOREIGN PATENT DOCUMENTS

| | | | |
|---|---|---|---|
| JP | 2007-044319 | A | 2/2007 |
| JP | 2008-048597 | A | 2/2008 |
| KR | 10-2001-0077535 | A | 8/2001 |
| KR | 10-2008-0099516 | A | 11/2008 |
| WO | 2007-143974 | A1 | 12/2007 |

* cited by examiner

*Primary Examiner* — Alexander Talpalatski
(74) *Attorney, Agent, or Firm* — Park & Associates IP Law, P.C.

(57) ABSTRACT

The present invention relates to a vibration generating shoe including: an upper part; an outsole part disposed on the underside of the upper part; and a vibration device having a vibration plate adapted to transmit vibrations to the shoe, a first magnet attached to the vibration plate, a second magnet disposed above the first magnet in such a manner as to have a repulsive force against the top surface of the first magnet, and a third magnet disposed below the first magnet in such a manner as to have a repulsive force against the underside surface of the first magnet, whereby a portion of the vibration plate to which the first magnet is fixed is vibrated between the second magnet and the third magnet.

3 Claims, 7 Drawing Sheets

VIBRATION GENERATING SHOE AND VIBRATION DEVICE THEREOF

REFERENCE TO RELATED APPLICATIONS

This is a continuation of pending International Patent Application PCT/KR2009/007249 filed on Dec. 5, 2009, which designates the United States and claims priority of Korean Patent Application No. 10-2009-0089184 filed on Sep. 21, 2009, the entire contents of which are incorporated herein by reference.

FIELD OF THE INVENTION

The present invention relates to a vibration generating shoe and a vibration device mounted in the shoe, and more particularly, to a vibration generating shoe that has a vibration device adapted to use the impacts and motions caused by a wearer's steps as an energy source and to generate vibrations therefrom, and to the vibration device mounted in the shoe.

BACKGROUND OF THE INVENTION

Recently, shoes having a variety of functions have been developed and proposed for the purpose of improving the health of wearers.

For example, there have been proposed functional shoes having outsoles having an arch-like shape capable of conducting rolling, that is, Masai walking. Functional shoes have been also proposed having sliding prevention means disposed on soles so as to prevent sliding while a wearer is walking. On the other hand, another functional shoes, which are capable of well absorbing the impacts generated from the wearer's steps, have been proposed and used.

The above-mentioned functional shoes are appropriately made in accordance with their original functions, and since they play very important roles for improving the health of the wearers, they have been widely used.

As the interest in health care becomes strong and the demands on more various functional shoes become increased, there is a definite need for the development of the shoes having new functions and capable of being worn in a more convenient manner.

SUMMARY OF THE INVENTION

Accordingly, the present invention has been made in view of the above-mentioned problems occurring in the prior art, and it is an object of the present invention to provide a vibration generating shoe that generates vibrations from a wearer's steps as an energy source, thereby providing exciting walking to the wearer.

It is another object of the present invention to provide a vibration device that is mounted in a shoe and generates vibrations from a wearer's steps.

To accomplish the above objects, according to an aspect of the present invention, there is provided a vibration generating shoe including: an upper part; an outsole part disposed on the underside of the upper part; and a vibration device having a vibration plate adapted to transmit vibrations to the shoe, a first magnet attached to the vibration plate, a second magnet disposed above the first magnet in such a manner as to have a repulsive force against the top surface of the first magnet, and a third magnet disposed below the first magnet in such a manner as to have a repulsive force against the underside surface of the first magnet, whereby a portion of the vibration plate to which the first magnet is fixed is vibrated between the second magnet and the third magnet.

According to the present invention, preferably, the outsole part has a vibration space portion formed therein to accommodate the vibration device thereinto, and the vibration plate has one end (a first end) fixed to one side of the vibration space portion and the other end (a second end) disposed in the space of the vibration space portion, while the first magnet is being attached to the second end of the vibration plate.

According to the present invention, preferably, the vibration device further includes a casing having an operating chamber formed thereinto, and the vibration plate has one end fixed to the casing within the operating chamber and the other end disposed in the space of the operating chamber, while the first magnet is being attached to the end portion of the other end of the vibration plate.

To accomplish the above objects, according to another aspect of the present invention, there is provided a vibration device mounted in a shoe, including: a vibration plate; a first magnet attached to the vibration plate; a second magnet disposed above the first magnet in such a manner as to have a repulsive force against the top surface of the first magnet; and a third magnet disposed below the first magnet in such a manner as to have a repulsive force against the underside surface of the first magnet, whereby a portion of the vibration plate to which the first magnet is fixed is vibrated between the second magnet and the third magnet.

According to the present invention, preferably, the vibration device further includes a casing having an operating chamber formed thereinto, and the vibration plate has one end fixed to the casing within the operating chamber and the other end disposed in the space of the operating chamber, while the first magnet is being attached to the end portion of the other end of the vibration plate.

According to the present invention, preferably, the second magnet is fixed to the upper portion of the casing, and the third magnet is fixed to the lower portion of the casing.

According to the present invention, the vibration plate of the vibration device mounted in each shoe is vibrated through the repulsive forces between the magnets caused by the energy sources of the impacts or motions generated from the wearer's steps.

Accordingly, the generation of the vibrations makes the wearer feel excited while he is walking or running, thereby allowing the walking and running activities to be held in the exciting and steady manner.

Further, the vibrations and the variations of the magnetic field generated from the vibration device are transmitted to the wearer's sole, thereby providing good blood circulation.

Additionally, the vibration device according to the present invention does not need any additional energy source like batteries so as to generate the vibrations therefrom, thereby making it possible to be used semi-permanently.

DETAILED DESCRIPTION OF THE INVENTION

Hereinafter, an explanation on a vibration generating shoe having a vibration device mounted therein for the purpose of improving blood circulation according to the present invention will be in detail given with reference to the attached drawings.

The terms used in the description and claims of the invention are not defined as a general or literal concept, but are defined as the concepts conforming to the technical spirit of the invention on the basis where the terms are appropriately defined to explain the invention best.

It will, therefore, be understood that the configurations described and illustrated in the invention is just a preferred embodiment of the present invention, and many changes, variations and modifications of the constructional details illustrated and described may be resorted to without departing from the spirit of the invention.

Figure 1:
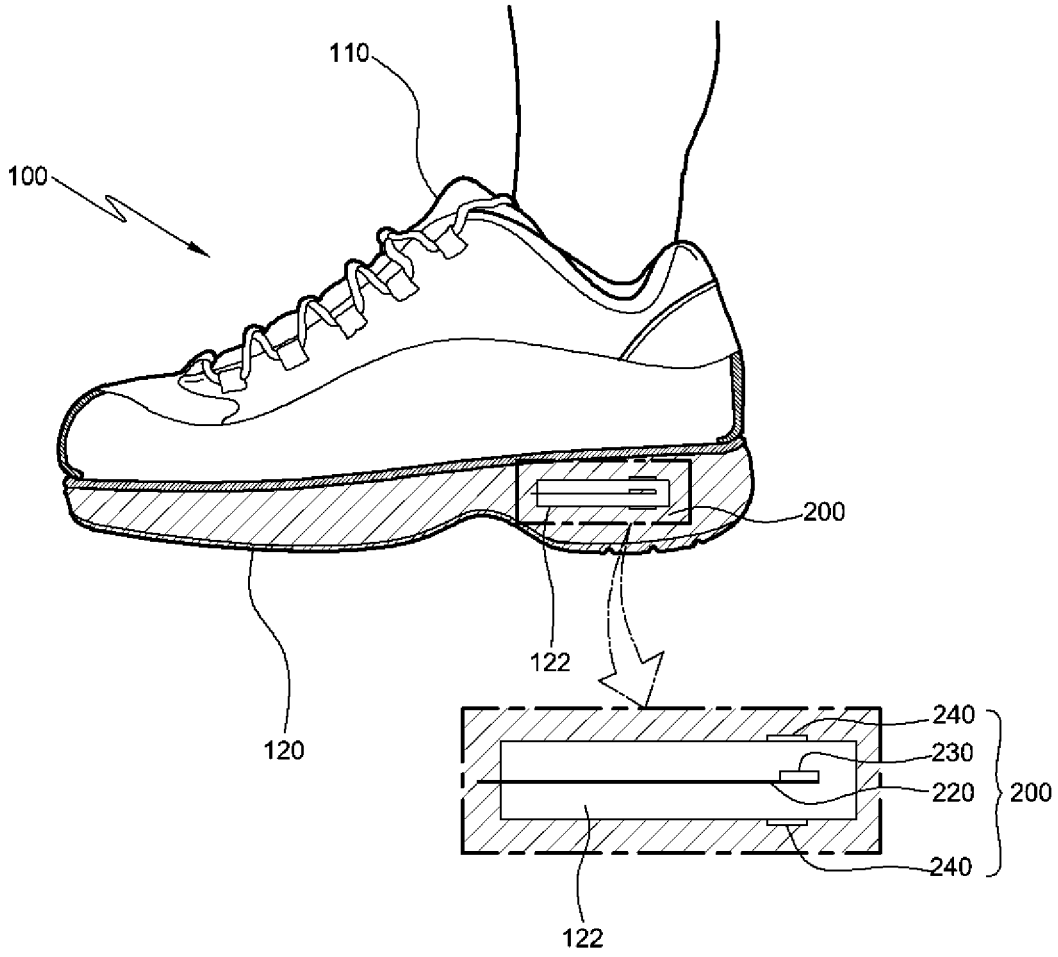
FIG. 1 is a schematic side sectional view showing a vibration generating shoe in which a vibration device is mounted according to a first embodiment of the present invention.
Figure 2:
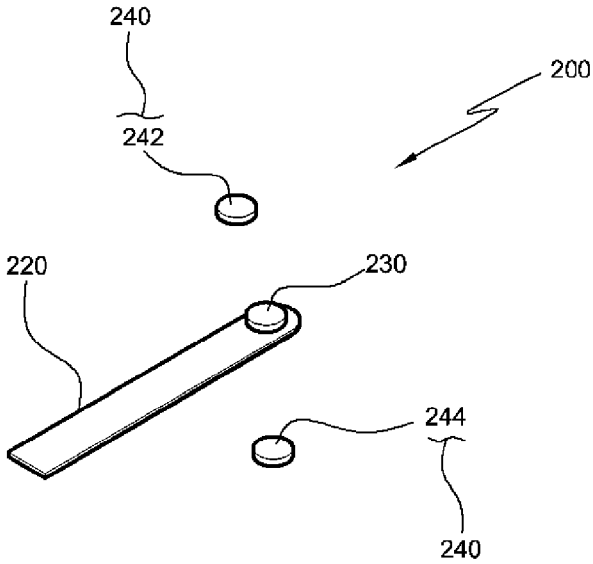
FIG. 2 is a perspective view showing the vibration device according to the present invention.
Figure 3:
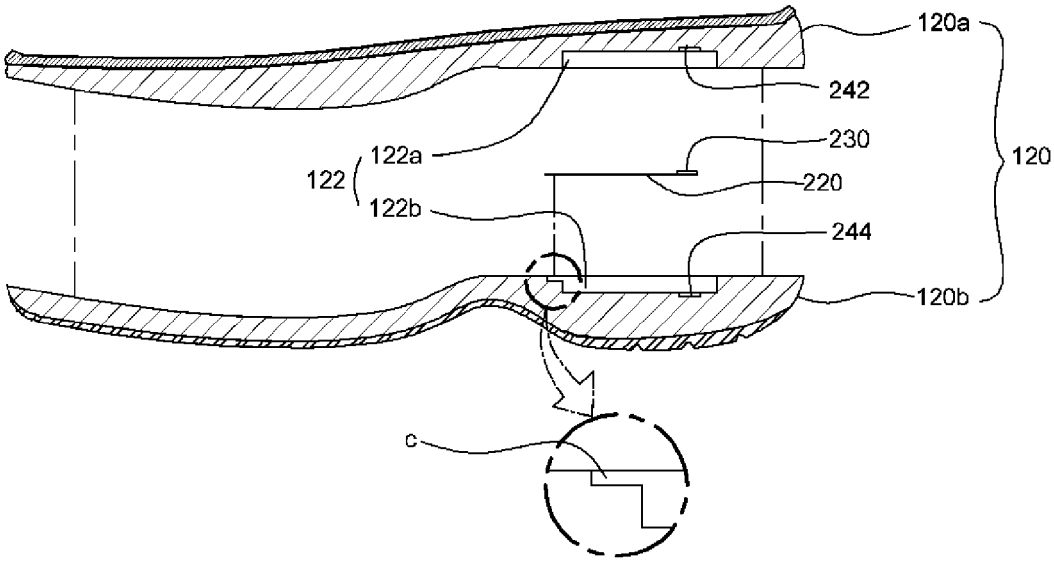
FIG. 3 is a schematic side sectional view showing the outsole part in which the vibration device is mounted according to the present invention.
Figure 4:
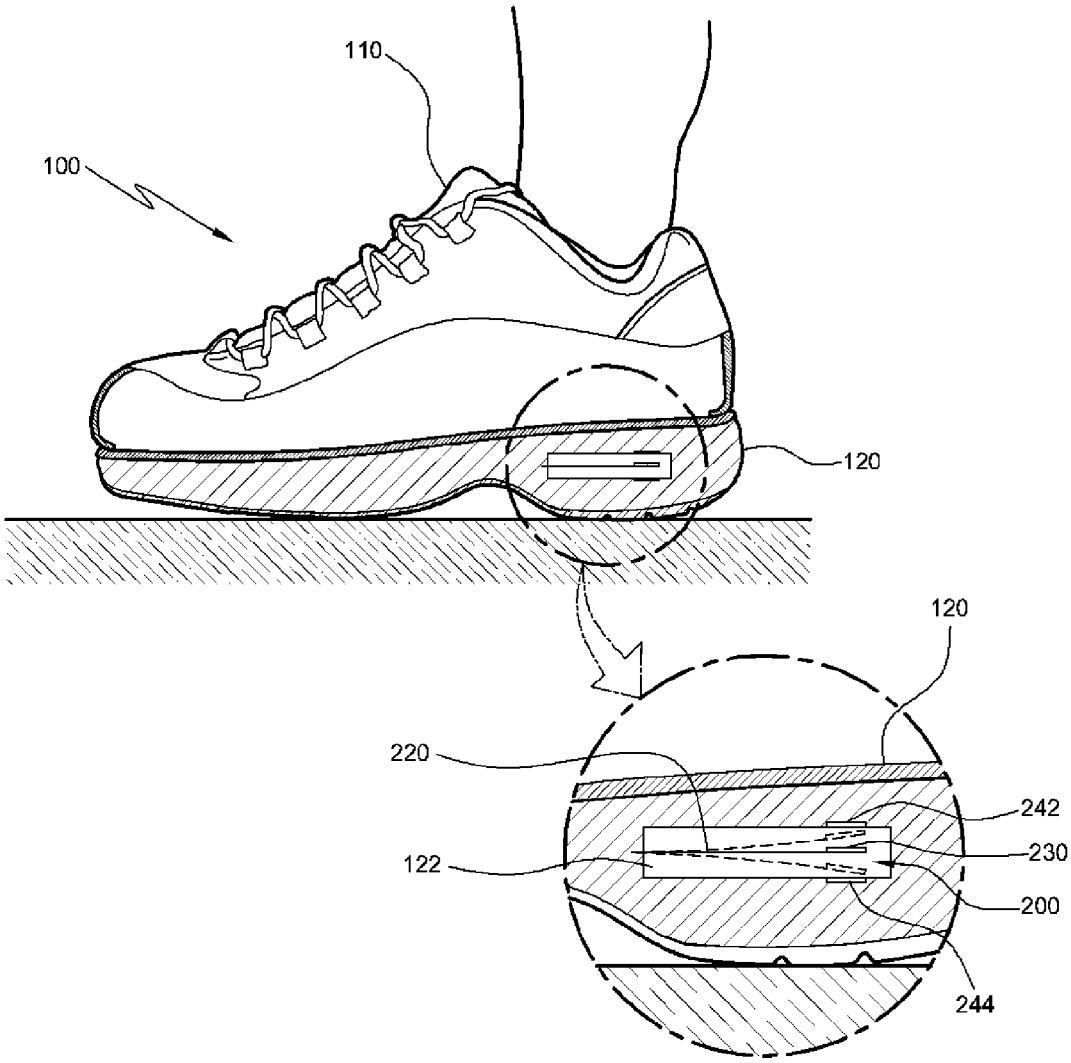
FIG. 4 is a schematic side sectional view showing the operation of the shoe while being worn according to the present invention.

FIG. 1 is a schematic side sectional view showing a vibration generating shoe in which a vibration device is mounted according to a first embodiment of the present invention, FIG. 2 is a perspective view showing the vibration device according to the present invention, FIG. 3 is a schematic side sectional view showing the outsole part in which the vibration device is mounted according to the present invention, and FIG. 4 is a schematic side sectional view showing the operation of the shoe while being worn according to the present invention.

Referring to FIGS. 1 to 4, the vibration generating shoe largely includes an upper part 110, an outsole part 120 and a vibration device 200.

First, the upper part 110 is adapted to surround a wearer's foot, and the outsole part 120 is adapted to protect the wearer's foot from the ground. They are widely used in all kinds of typical shoes, and therefore, an explanation on them will be avoided for the brevity of the description. According to the present invention, however, the outsole part 120 desirably has a vibration space portion 122 formed on the rear thereof, and of course, the vibration space portion 122 may be formed on the front thereof, which is not specifically defined thereon.

Next, the vibration device 200 is disposed inside the vibration space portion 122 formed on the outsole part 120. Accordingly, the vibration device 200 induces vibrations with the energy source caused from the impacts generated from the wearer's steps, thereby making him feel excited during his walking, and transmits a magnetic field to his sole, thereby improving the blood circulation. The vibration device 200 largely includes a vibration plate 220, a first magnet 230 and a repulsive magnet 240.

The vibration plate 220 is fixed at one end thereof to the interior of the vibration space portion 122 so as to transmit the generated vibrations to the shoe. The other end of the vibration plate 220 is extended to the opposite side from the fixed portion thereof in such a manner as to be located in the space of the vibration space portion 122. Also, the vibration plate 220 is formed of a substantially thin elastic material capable of easily generating vibrations therefrom.

Further, the first magnet 230 is attached to the end portion of the other end of the vibration plate 220, that is, the end portion of the vibration plate 220 not fixed to the vibration space portion 122, which is adapted to induce the vibrations of the vibration plate 220. Through the attachment of the first magnet 230 thereto, that is, the vibration plate 220 has a given weight on the end portion of the other end thereof and is thus reacted to small impacts or motions. At this time, the top surface of the first magnet 230 has a south pole and the underside surface thereof has a north pole. Of course, such location of the first magnet 230 may be varied if necessary.

Also, the repulsive magnet 240 is disposed inside the vibration space portion 122 and has the repulsive action against the top and underside surfaces of the first magnet 230, while at the same time generating magnet forces therefrom. The repulsive magnet 240 includes a second magnet 242 disposed above the first magnet 230, that is, on the top surface of the vibration space portion 122, and a third magnet 244 disposed below the first magnet 230, that is, on the underside surface of the vibration space portion 122. The second magnet 242 and the third magnet 244 are disposed on the almost same vertical line as the first magnet 230, and alternatively, they are disposed on the moving line of the end of the vibration plate 220 during the vibrations in the circumferential direction.

So as to generate the repulsive force against the top surface of the first magnet 230, at this time, the second magnet 242 is disposed to have the south pole on the underside surface thereof and the north pole on the top surface thereof, and so as to generate the repulsive force against the underside surface of the first magnet 230, also, the third magnet 244 is disposed in the opposite order to the second magnet 242. Of course, the second magnet 242 and the third magnet 244 may be changed in the pole positions in accordance with the pole positions of the first magnet 230.

Under the above-mentioned configuration, the vibration device 200 is disposed as shown in FIG. 3.

That is, the outsole part 120 is formed divided into a first outsole part 120*a* and a second outsole part 120*b*, and thus, recesses 122*a* and 122*b* are formed on the rear portions of the first outsole part 120*a* and the second outsole part 120*b*, which become the vibration space portion 122 when the first outsole part 120*a* and the second outsole part 120*b* are coupled to each other. One end of the vibration plate 220 is located on the top surface of the second outsole part 120*b*, and the other end thereof to which the first magnet 230 is attached is located in the recess 122*b*, that is, inside the vibration space portion 122. At this time, the second outsole part 120*b* desirably has a seating groove c adapted to seat one end of the vibration plate 220 thereon, and only one end of the vibration plate 220 is desirably seated on the seating groove c. Further, the second magnet 242 of the repulsive magnet 240 is attached to the recess 122*a* formed on the first outsole part 120*a*, that is, to the top surface of the vibration space portion 122. On the other hand, the third magnet 244 of the repulsive magnet 240 is attached to the recess 122*b* formed on the second outsole part 120*b*, that is, to the underside surface of the vibration space portion 122. After that, the underside surface of the first outsole part 120*a* and the top surface of the second outsole part 120*b* are bonded to each other, thereby completing the installation of the vibration device 200. Of course, upon the attachment of the second magnet 242 and the third magnet 244, as mentioned above, their position should be previously set so as to generate the repulsive forces against the first magnet 230.

On the other hand, one end of the vibration plate 220, that is, the end portion thereof seated on the seating groove c of the second outsole part 120*b* is not shown in the drawings. In this case, one end of the vibration plate 220 has an approximately "T"-like shape, and the seating groove c has a "T"-like shape on the plane, so that one end of the vibration plate 220 is rigidly fixed between the first outsole part 120*a* and the second outsole part 120*b*, without any easy escape therefrom.

Next, an explanation on the operation of the vibration generating shoe according to the present invention will be given.

That is, as shown in FIG. 4, if the wearer starts to walk or run, the vibration device 200 disposed inside the outsole part 120 receives the impacts and motions generated from his walking or running. With the energy source caused from the walking motions, accordingly, the end portion of the vibration plate 220 to which the first magnet 230 is attached starts to be vibrated slightly in upward and downward directions, together with the first magnet 230 attached thereto. At this time, since the first magnet 230 is attached to the end portion of the vibration plate 220, the vibration plate 220 is easily moved upwardly and downwardly even with small impacts and motions.

Accordingly, the motion of the wearer's foot caused by his steps induces the vibrations of the vibration plate 220, and the first magnet 230 attached to the end of the vibration plate 220 generates the repulsive force against the second magnet 242 and the third magnet 244 disposed on the top and underside of the vibration space portion 122, thereby causing the vibration plate 220 to be strongly vibrated. Through the motions of the vibration plate 220, in other words, if the first magnet 230 attached to the end of the vibration plate 220 is moved downwardly, it generates the repulsive force against the third magnet 244 disposed on the underside surface of the vibration space portion 122, thereby making it spring upwardly. After that, the first magnet 230 generates the repulsive force against the second magnet 242 disposed on the top surface of the vibration space portion 122 again, thereby making it spring downwardly. Like this, the portion of the vibration plate 220 to which the first magnet 230 is attached is vibrated within the vibration space portion 122 through the repulsive action.

Accordingly, the wearer feels the vibrations of the vibration plate 220, which increases his interests on his steps and makes him feel excited during his walking. Also, the magnetic field between the first magnet 230 and the second magnet 242 and the vibrations of the vibration plate 220 are transmitted to his sole, thereby accelerating his blood circulation and improving his health.

As described above, the vibration device according to the present invention 200 is disposed directly inside the vibration space portion 122 formed into the outsole part 120, but may be disposed in different manners therefrom. Hereinafter, such configuration will be described.

Figure 5:
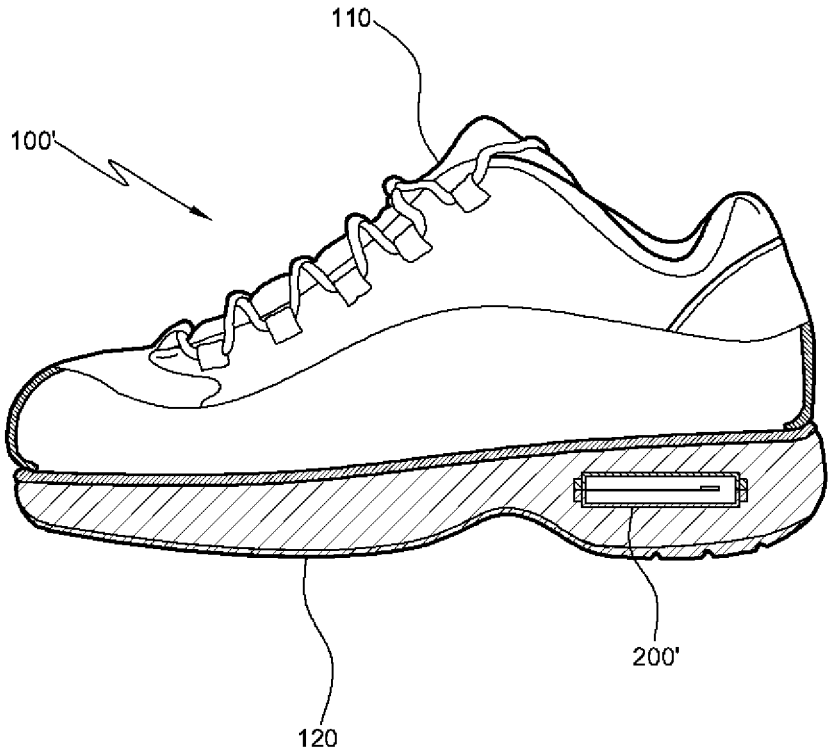
FIG. 5 is a schematic side sectional view showing a vibration generating shoe in which a vibration device is mounted according to a second embodiment of the present invention.
Figure 6:
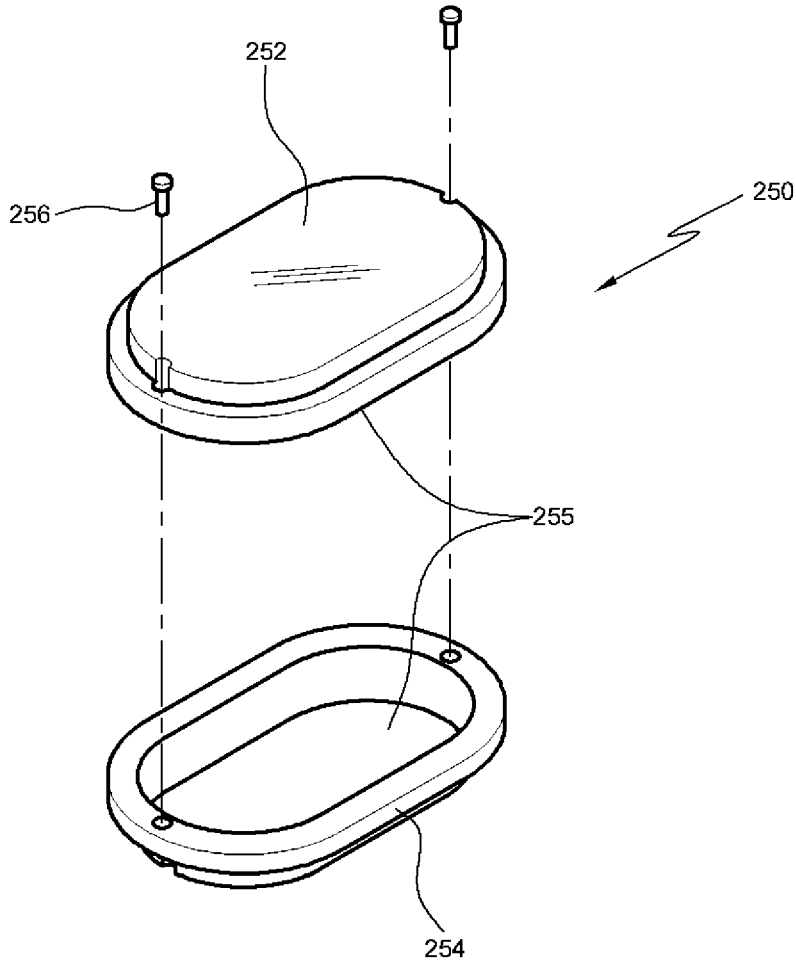
FIG. 6 is a separate perspective view showing a casing separated from the shoe according to the second embodiment of the present invention.

FIG. 5 is a schematic side sectional view showing a vibration generating shoe in which a vibration device is mounted according to a second embodiment of the present invention, and FIG. 6 is a separate perspective view showing a casing separated from the shoe according to the second embodiment of the present invention. Also, FIG. 7 is a schematic longitudinal view showing the mounted state of the vibration device according to the second embodiment of the present invention.

In the second embodiment of the present invention, the parts corresponding to those of the first embodiment of the present invention are indicated by corresponding reference numerals, and for the brevity of the description, they will be briefly described.

Figure 7:
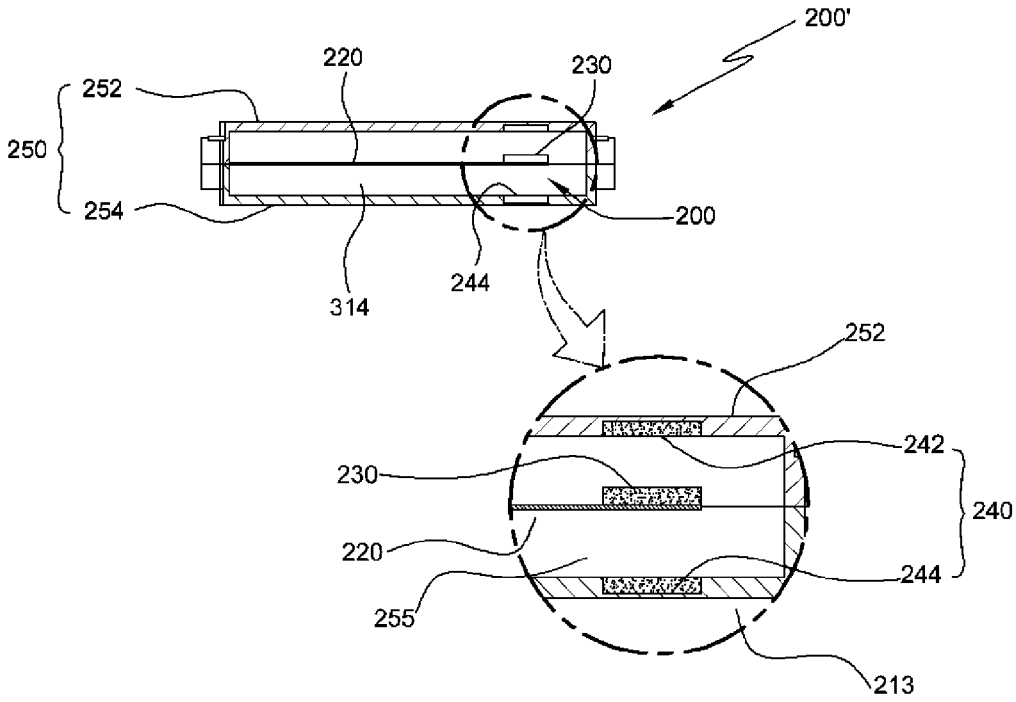
FIG. 7 is a schematic longitudinal view showing the mounted state of the vibration device according to the second embodiment of the present invention.

Referring to FIGS. 5 to 7, a vibration generating shoe 100' according to the second embodiment of the present invention includes an upper part 110, an outsole part 120 disposed on the underside of the upper part 110, and a vibration device 200' disposed in the outsole part 120, and the vibration device 200' has a casing 250. The vibration generating shoe 100' according to the second embodiment of the present invention has the same configuration as that according to the first embodiment of the present invention, except that the vibration device 200' is protected by the casing 250 and is disposed in the outsole part 120, while not disposed directly into the vibration space portion 122 formed in the outsole part 120.

On the other hand, the casing 250 consists of upper and lower cases 252 and 254 separably coupled to each other by means of screws 256, and coupling of the upper and lower cases 252 and 254 forms an operating chamber 255 into which the vibration plate 220 is disposed and operated. The casing 250 is made of a synthetic resin or an elastic material. The casing 250 is disposed in the outsole part 120, and even if not shown, further, the casing 250 may be disposed on any one side of the upper part 110. Furthermore, the casing 250 may be disposed on every portion of the shoe if the motions or impacts caused from the wearer's steps are applied thereto.

An explanation on the configuration of the vibration device 200' having the casing 250 provided thereon will be given. In this case, the first magnet 230 and the second magnet 242 and the third magnet 244 disposed above and below the first magnet 230 have the almost same configurations as those in the first embodiment of the present invention as shown in FIGS. 1 to 4, and therefore, they will be described briefly.

That is, one end of the vibration plate 220 is fixedly disposed on the coupled surface between the upper case 252 and the lower case 254, and the other end thereof is disposed in the space of the operating chamber 255. The first magnet 230 is attached to the other end of the vibration plate 220, that is, to the end of the vibration plate 220 disposed in the space of the operating chamber 255. Also, the second magnet 242 is fixed to the top portion of the casing 250, and the third magnet 244 to the bottom portion of the casing 250. In more detail, the second magnet 242 generating the repulsive force against the top surface of the first magnet 230 is embedded into the upper case 252, and the third magnet 244 generating the repulsive force against the underside surface of the first magnet 230 is embedded into the lower case 254.

Like this, if the vibration device 200' is disposed inside the casing 250, it is embedded thereinto upon the molding of the outsole part 120, thereby easily manufacturing the shoe having the function of generating vibrations and more improving the durability of the outsole part 120 than that in the first embodiment of the present invention.

The operation of the vibration generating shoe 100' according to the second embodiment of the present invention is the same as that according to the first embodiment of the present invention, and therefore, it will be briefly described below. That is, if the wearer starts to walk, the vibration plate 220 disposed inside the operating chamber 255 of the casing 250 starts to be vibrated slightly through the impacts and motions generated from his steps. After that, the vibrations and magnetic forces are generated through the repulsive forces of the first magnet 230 against the second and third magnets 242 and 244 disposed on the top and underside surface of the casing 250.

As mentioned above, the vibration plate 220 is vibrated without any trouble, but so as to achieve more large vibrations, a plurality of vibration plates may be provided.

Figure 8:
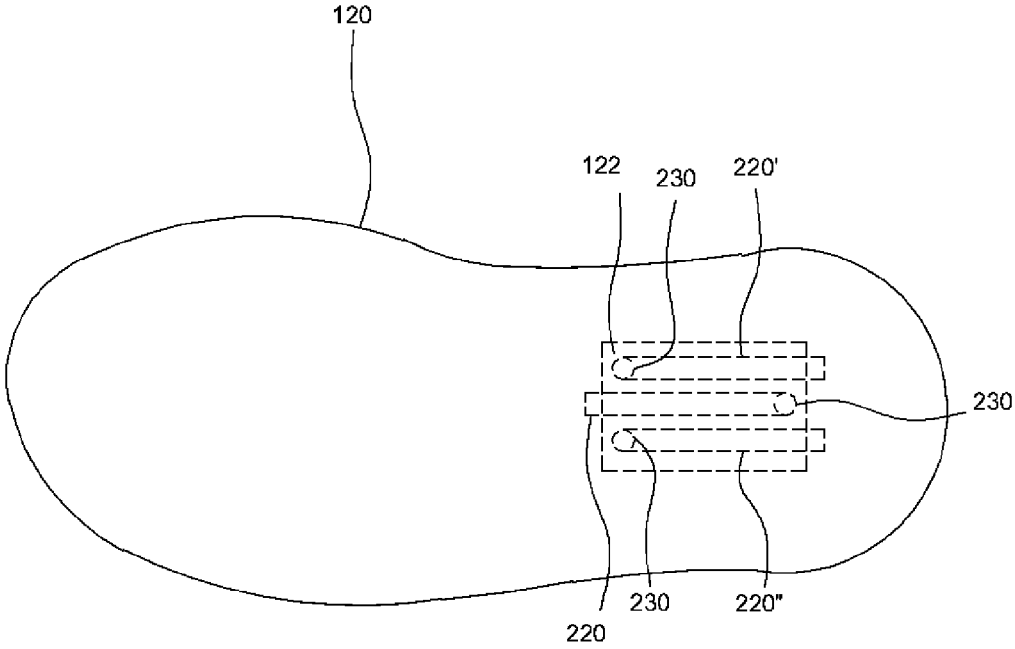
FIG. 8 is a schematic view showing the flat surface of the outsole part of a vibration generating shoe according to a third embodiment of the present invention.

FIG. 8 is a schematic view showing the flat surface of the outsole part of a vibration generating shoe according to a third embodiment of the present invention.

Referring to FIG. 8, a plurality of vibration plates 220, 220' and 220" are disposed inside the vibration space portion 122 of the outsole part 120. That is, other vibration plates 220' and 220" are disposed on both sides of the vibration plate 220 located at the center of the vibration space portion 122. The free ends of the respective vibration plates have the first magnets 230, and even if not shown, the repulsive magnets 240 are disposed on the top and underside of the vibration space portion 122.

Under the above-mentioned configuration, if the wearer walks, the three vibration plates 200, 220' and 220" are vibrated, thereby making him feel relatively large vibrations. As a result, one or more vibration plates can be disposed to achieve more strong vibration results.

Figure 9:
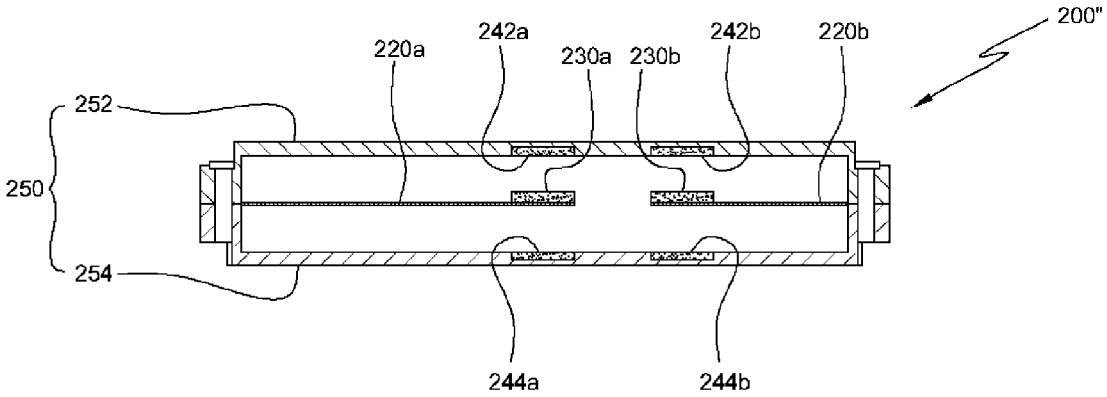
FIG. 9 is a longitudinal sectional view showing another example of the vibration device according to the present invention.

FIG. 9 is a longitudinal sectional view showing another example of the vibration device according to the present invention.

A vibration device 200" as shown in FIG. 9 has a plurality of vibration plates 220*a* and 220*b* having different lengths from each other. Accordingly, the vibration plates 220*a* and 220*b* have the different numbers of vibrations therefrom when they receive the same impacts as each other. As shown in FIG. 9, the vibration plate 220*a* on the left side thereof is longer than the vibration plate 220*b* on the right side thereof, and above and below the respective vibration plates 220*a* and 220*b* are disposed the repulsive magnets 242*a*, 244*a*, 242*b* and 244*b*. Like this, the numbers of vibrations (frequencies) of the vibration plates in the single vibration device 200" are different from each other, thereby making the vibrations felt by the wearer different from the vibrations caused from the vibration plates having the same length as each other. Accordingly, the shoe having various vibrations can be manufactured, thereby permitting the wearer to experience the vibrations in various manners.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The vibration generating shoe and the vibration device mounted inside the shoe according to the preferred embodiments of the present invention generate vibrations from the wearer's steps, thereby allowing his walking and running activities to be held in a more exciting manner and thereby being usefully utilized in the industrial field of shoes.

What is claimed is:

1. A vibration generating shoe comprising:

an upper part;

an outsole part disposed on the underside of the upper part; and a vibration device having a vibration plate adapted to transmit vibrations to the shoe, a first magnet attached to the vibration plate, a second magnet disposed above the first magnet in such a manner as to have a repulsive force against the top surface of the first magnet, and a third magnet disposed below the first magnet in such a manner as to have a repulsive force against the underside surface of the first magnet, whereby a portion of the vibration plate to which the first magnet is fixed is vibrated between the second magnet and the third magnet.

2. The vibration generating shoe according to claim 1, wherein the outsole part has a vibration space portion formed therein to accommodate the vibration device thereinto, and the vibration plate has a first end fixed to one side of the vibration space portion and a second end disposed in the space of the vibration space portion, while the first magnet is being attached to the second end of the vibration plate.

3. The vibration generating shoe according to claim 1, wherein the vibration device further comprises a casing having an operating chamber formed thereinto, and the vibration plate has a first end fixed to the casing within the operating chamber and a second end disposed in the space of the operating chamber, while the first magnet is being attached to the second end of the vibration plate.

* * * * *